US007610196B2

(12) United States Patent
Nongpiur et al.

(10) Patent No.: US 7,610,196 B2
(45) Date of Patent: Oct. 27, 2009

(54) PERIODIC SIGNAL ENHANCEMENT SYSTEM

(75) Inventors: Rajeev Nongpiur, Burnaby (CA); David Giesbrecht, Vancouver (CA); Phillip Hetherington, Port Moody (CA)

(73) Assignee: QNX Software Systems (Wavemakers), Inc., Vacouver, British Columbia (CA)

( * ) Notice: Subject to any disclaimer, the term of this patent is extended or adjusted under 35 U.S.C. 154(b) by 904 days.

(21) Appl. No.: 11/102,251

(22) Filed: Apr. 8, 2005

(65) Prior Publication Data

US 2006/0089959 A1 Apr. 27, 2006

Related U.S. Application Data

(63) Continuation-in-part of application No. 10/973,575, filed on Oct. 26, 2004.

(51) Int. Cl.
*G10L 19/02* (2006.01)

(52) U.S. Cl. ..... 704/206

(58) Field of Classification Search ..... 704/206
See application file for complete search history.

(56) References Cited

U.S. PATENT DOCUMENTS

| | | | | |
|---|---|---|---|---|
| 4,282,405 | A | | 8/1981 | Taguchi |
| 4,486,900 | A | | 12/1984 | Cox et al. |
| 4,531,228 | A | | 7/1985 | Noso et al. |
| 4,628,156 | A | | 12/1986 | Irvin |
| 4,630,305 | A | | 12/1986 | Borth et al. |
| 4,791,390 | A | | 12/1988 | Harris et al. |
| 4,811,404 | A | | 3/1989 | Vilmur et al. |
| 4,843,562 | A | | 6/1989 | Kenyon et al. |
| 4,939,685 | A | | 7/1990 | Feintuch |
| 4,969,192 | A | * | 11/1990 | Chen et al. ..... 704/222 |
| 5,027,410 | A | | 6/1991 | Williamson et al. |
| 5,056,150 | A | | 10/1991 | Yu et al. |
| 5,146,539 | A | | 9/1992 | Doddington et al. |
| 5,278,780 | A | | 1/1994 | Eguchi et al. |
| 5,313,555 | A | | 5/1994 | Kamiya |
| 5,377,276 | A | | 12/1994 | Terai et al. |
| 5,400,409 | A | | 3/1995 | Linhard |

(Continued)

FOREIGN PATENT DOCUMENTS

| | | |
|---|---|---|
| CA | 2158847 | 9/1994 |

(Continued)

OTHER PUBLICATIONS

Ismo Kauppinen, "Methods for Detecting Impulsive Noise in Speech and Audio Signals", pp. 967-970, IEEE 2002.

(Continued)

*Primary Examiner*—Susan McFadden
(74) *Attorney, Agent, or Firm*—Brinks Hofer Gilson & Lione

(57) ABSTRACT

A signal enhancement system improves the understandability of speech or other audio signals. The system reinforces selected parts of the signal, may attenuate selected parts of the signal, and may increase SNR. The system includes delay logic, a partitioned adaptive filter, and signal reinforcement logic. The partitioned adaptive filter may track and enhance the fundamental frequency and harmonics in the input signal. The partitioned filter output signals may approximately reproduce the input signal, delayed by an integer multiple of the period of the fundamental frequency of the input signal. The reinforcement logic combines the input signal and the filtered signals to produce an enhanced output signal.

52 Claims, 12 Drawing Sheets

U.S. PATENT DOCUMENTS 5,406,622 A 4/1995 Silverberg et al.
5,412,735 A 5/1995 Engebretson et al.
5,432,859 A 7/1995 Yang et al.
5,479,517 A 12/1995 Linhard
5,495,415 A 2/1996 Ribbens et al.
5,502,688 A 3/1996 Recchione et al.
5,526,466 A 6/1996 Takizawa
5,568,559 A 10/1996 Makino
5,572,262 A 11/1996 Ghosh
5,584,295 A 12/1996 Muller et al.
5,590,241 A 12/1996 Park et al.
5,615,298 A * 3/1997 Chen ..... 704/228
5,641,931 A 6/1997 Ogai et al.
5,677,987 A 10/1997 Seki et al.
5,680,508 A 10/1997 Liu
5,692,104 A 11/1997 Chow et al.
5,701,344 A 12/1997 Wakui
5,714,997 A 2/1998 Anderson
5,819,215 A * 10/1998 Dobson et al. ..... 704/230
5,845,243 A * 12/1998 Smart et al. ..... 704/200.1
5,920,840 A * 7/1999 Satyamurti et al. ..... 704/267
5,920,848 A 7/1999 Schutzer et al.
5,933,801 A 8/1999 Fink et al.
5,949,886 A 9/1999 Nevins et al.
5,949,888 A 9/1999 Gupta et al.
5,953,694 A 9/1999 Pillekamp
6,011,853 A 1/2000 Koski et al.
6,084,907 A * 7/2000 Nagano et al. ..... 375/230
6,111,957 A 8/2000 Thomasson
6,144,336 A 11/2000 Preston et al.
6,163,608 A 12/2000 Romesburg et al.
6,167,375 A 12/2000 Miseki et al.
6,173,074 B1 1/2001 Russo
6,175,602 B1 1/2001 Gustafsson et al.
6,192,134 B1 2/2001 White et al.
6,199,035 B1 3/2001 Lakaniemi et al.
6,219,418 B1 4/2001 Eriksson et al.
6,249,275 B1 6/2001 Kodama
6,282,430 B1 8/2001 Young
6,405,168 B1 6/2002 Bayya et al.
6,408,273 B1 6/2002 Quagliaro et al.
6,434,246 B1 8/2002 Kates et al.
6,473,409 B1 10/2002 Malvar
6,493,338 B1 12/2002 Preston et al.
6,507,814 B1 1/2003 Gao
6,587,816 B1 7/2003 Chazan et al.
6,633,894 B1 * 10/2003 Cole ..... 708/300
6,643,619 B1 11/2003 Linhard et al.
6,687,669 B1 2/2004 Schrögmeier et al.
6,690,681 B1 2/2004 Preston et al.
6,725,190 B1 4/2004 Chazan et al.
6,771,629 B1 8/2004 Preston et al.
6,782,363 B2 8/2004 Lee et al.
6,804,640 B1 10/2004 Weintraub et al.
6,822,507 B2 11/2004 Buchele
6,836,761 B1 12/2004 Kawashima et al.
6,859,420 B1 2/2005 Coney et al.
6,871,176 B2 3/2005 Choi et al.
6,891,809 B1 5/2005 Ciccone et al.
6,898,293 B2 5/2005 Kaulberg
6,910,011 B1 6/2005 Zakarauskas
6,937,978 B2 8/2005 Liu
7,020,291 B2 3/2006 Buck et al.
7,117,149 B1 10/2006 Zakarauskas
7,146,012 B1 12/2006 Belt et al.
7,146,316 B2 12/2006 Alves
7,167,516 B1 1/2007 He
7,167,568 B2 1/2007 Malvar et al.
7,206,418 B2 4/2007 Yang et al.
7,231,347 B2 6/2007 Zakarauskas
7,269,188 B2 9/2007 Smith
7,272,566 B2 * 9/2007 Vinton ..... 704/500
2001/0028713 A1 10/2001 Walker
2002/0052736 A1 5/2002 Kim et al.
2002/0071573 A1 6/2002 Finn
2002/0176589 A1 11/2002 Buck et al.
2003/0040908 A1 2/2003 Yang et al.
2003/0093265 A1 5/2003 Xu et al.
2003/0093270 A1 5/2003 Domer
2003/0101048 A1 5/2003 Liu
2003/0206640 A1 11/2003 Malvar et al.
2003/0216907 A1 11/2003 Thomas
2004/0002856 A1 1/2004 Bhaskar et al.
2004/0024600 A1 2/2004 Hamza et al.
2004/0071284 A1 4/2004 Abutalebi et al.
2004/0078200 A1 4/2004 Alves
2004/0138882 A1 7/2004 Miyazawa
2004/0165736 A1 8/2004 Hetherington et al.
2004/0167777 A1 8/2004 Hetherington et al.
2004/0179610 A1 9/2004 Lu et al.
2005/0075866 A1 4/2005 Widrow
2005/0114128 A1 5/2005 Hetherington et al.
2005/0240401 A1 10/2005 Ebenezer
2006/0034447 A1 2/2006 Alves et al.
2006/0056502 A1 3/2006 Callicotte
2006/0074646 A1 4/2006 Alves et al.
2006/0089958 A1 4/2006 Giesbrecht et al.
2006/0089959 A1 4/2006 Nongpiur et al.
2006/0100868 A1 5/2006 Hetherington et al.
2006/0115095 A1 6/2006 Giesbrecht et al.
2006/0116873 A1 6/2006 Hetherington et al.
2006/0251268 A1 11/2006 Hetherington et al.
2006/0287859 A1 12/2006 Hetherington et al.
2007/0033031 A1 2/2007 Zakarauskas
2007/0136055 A1 6/2007 Hetherington

FOREIGN PATENT DOCUMENTS

CA 2157496 10/1994
CA 2158064 10/1994
EP 0 076 687 A1 4/1983
EP 0 275 416 7/1988
EP 0 629 996 A2 12/1994
EP 0 629 996 A3 12/1994
EP 0 750 291 A1 12/1996
EP 1 450 353 A1 8/2004
EP 1 450 354 A1 8/2004
EP 1 669 983 A1 6/2006
JP 06269084 A2 9/1994
JP 06319193 A 11/1994
WO WO 0041169 A1 7/2000
WO WO 0156255 A1 8/2001
WO WO 0173761 A1 10/2001

OTHER PUBLICATIONS

Saeed V. Vaseghi and Peter J.W. Rayner, "The Effects of Non-Stationary Signal Characteristics on the Performance of Adaptive Audio Restoration System", pp. 377-380, IEEE 1989.

Bilcu, et al., "A New Variable Length LMS Algorithm: Theoretical Analysis and Implementations", 2002 IEEE, pp. 1031-1034.

Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.

Fiori, S., Uncini, A., and Piazza, F., "Blind Deconvolution by Modified Bussgang Algorithm", Dept. of Electronics and Automatics—University of Ancona (Italy), ISCAS 1999.

Vieira, J., "Automatic Estimation of Reverberation Time", Audio Engineering Society, Convention Paper 6107, 116$^{th}$ Convention, May 8-11, 2004, Berlin, Germany, pp. 1-7.

Pornimitkul, Pradya Et Al., 2102797 Statistic Digital Signal Processing, Comparison of NLMS and RLS For Acoustic Echo cancellation (AEC) and White Gaussian Noise (WGN), Department of Electrical Engineering Faculty of Engineering, 2002, pp. 1-19.

Nascimento, Vitor H., "Improving the Initial Convergence Of Adaptive Filters Variable-Length LMS Algorithms", 2002 IEEE, pp. 667-670.
Avendano, C., et al., "Study on Dereverberation of Speech Based on Temporal Envelope Filtering", in Proc. ICSLP'96, Philadelphia, pp. 889-892, Oct. 1996.
Anderson C.M., et al: "Adaptive Enhancement of Finite Bandwidth Signals in White Gaussian Noise", IEEE Trans. On Acoustics, Speech and Signal Processing, vol. ASSP-31, No. 1, Feb. 1983, pp. 17-28.
Byun K.J., et al: "Noise Whitening-Based Pitch Detection for Speech Highly Corrupted by Colored Noise", ETRI Journal, vol. 25, No. 1, Feb. 2003, pp. 49-51.
Campbell D.A., et al: "Dynamic Weight Leakage for LMS Adaptive Linear Predictors", Tencon'96 Proceedings, 1996 IEEE Tencon Digital Signal Processing Applications Perth, WA, Australia Nov. 26-29, 1996, NY, NY, USA, IEEE, US, vol. 2, Nov. 26, 1996, pp. 574-579.
Chang J.H., et al: "Pitch Estimation of Speech Signal Based on Adaptive Lattice Notch Filter", Signal Processing, Elsevier Science Publishers B.V. Amsterdam, NL, vol. 85, No. 3, Mar. 2005, pp. 637-641.
Learned, R.E. et al., A Wavelet Packet Approach to Transient Signal Classification, Applied and Computational Harmonic Analysis, Jul. 1995, pp. 265-278, vol. 2, No. 3, USA, XP000972660. ISSN: 1063-5203. abstract.
Quatieri, T.F. et al., Noise Reduction Using a Soft-Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.
Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.
Rabiner L.R., et al: "A Comparative Performance Study of Several Pitch Detection Algorithms", IEEE Trans. On Acoustics, Speech and Signal Processing, vol. ASSP-24, No. 5, Oct. 1976, pp. 399-418.
Sasaoka N, et al: "A New Noise Reduction System Based on ALE and Noise Reconstruction Filter", Circuits and Systems, 2005. ISCAS 2005. IEEE International Symposium on KOBE, Japan May 23-26, 2005, Piscataway, NJ USA, IEEE May 23, 2005, pp. 272-275.
Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.
Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.
Kang, Hae-Dong; "Voice Enhancement Using a Single Input Adaptive Noise Elimination Technique Having a Recursive Time-Delay Estimator", Kyungbook National University (Korea), Doctoral Thesis, Dec. 31, 1993, pp. 11-26.
Berk et al., "Data Analysis with Microsoft Excel", Duxbury Press, 1998, pp. 236-239 and 256-259.
Puder, H. et al., "Improved Noise Reduction for Hands-Free Car Phones Utilizing Information on a Vehicle and Engine Speeds", Sep. 4-8, 2000, pp. 1851-1854, vol. 3, XP009030255, 2000. Tampere, Finland, Tampere Univ. Technology, Finland Abstract.
Seely, S., "An Introduction to Engineering Systems", Pergamon Press Inc., 1972, pp. 7-10.
Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.
Shust, Michael R. and Rogers, James C., "Electronic Removal of Outdoor Microphone Wind Noise", obtained from the Internet on Oct. 5, 2006 at: <http://www.acoustics.org/press/136th/mshust.htm>, 6 pages.
Wahab A. et al., "Intelligent Dashboard With Speech Enhancement", Information, Communications, and Signal Processing, 1997. ICICS, Proceedings of 1997 International Conference on Singapore, Sep. 9-12, 1997, New York, NY, USA, IEEE, pp. 993-997.
The prosecution history of U.S. Appl. No. 10/973,575 shown in the attached Patent Application Retrieval filr wrapper document list, printed Nov. 21, 2008, including any substantive Office Actions and Applicant Responses.
The prosecution history of U.S. Appl. No. 11/101,796 shown in the attached Patent Application Retrieval file wrapper document list, printed Dec. 3, 2008, including any substantive Office Actions and Applicant Responses.
The prosecution history of U.S. Appl. No. 11/317,762 shown in the attached Patent Application Retrieval file wrapper document list, printed Nov. 21, 2008, including any substantive Office Actions and Applicant Responses.
The prosecution history of U.S. Appl. No. 11/298,052 shown in the attached Patent Application Retrieval file wrapper document list, printed Nov. 21, 2008, including any substantive Office Actions and Applicant Responses.
The prosecution history U.S. Appl. No. 11/757,768 shown in the attached Patent Application Retrieval file wrapper document list, printed Nov. 21, 2008, including any substantive Office Actions and Applicant Responses.
The prosecution history of U.S. Appl. No. 11/849,009 shown in the attached Patent Application Retrieval file wrapper document list, printed Nov. 21, 2008, including any substantive Office Actions and Applicant Responses.
Koike, Shiin'ichi, "Adaptive Threshold Nonlinear Algorithm for Adaptive Filters with Robustness Against Impulse Noise," 1996, IEEE, NEC Corporation, Tokyo 108-01, pp. 1644-1647.
Tam, et al., "Highly Oversampled Subband Adaptive Filters for Noise Cancellation on a Low-resource DSP System," Proc. Of Int. Conf. on Spoken Language Processing (ICSLP), Sep. 2002, pp. 1-4.

* cited by examiner

300

400

1002

1008

PERIODIC SIGNAL ENHANCEMENT SYSTEM

PRIORITY CLAIM

This application is a Continuation in Part Application of U.S. patent application Ser. No. 10/973,575, filed Oct. 26, 2004, titled Periodic Signal Enhancement System. This application is related to U.S. patent application Ser. No. 11/101,796, filed Apr. 8, 2005, also titled Periodic Signal Enhancement System.

BACKGROUND OF THE INVENTION

1. Technical Field

This invention relates to signal processing systems, and more particularly to a system that may enhance periodic signal components.

2. Related Art

Signal processing systems support many roles. Audio signal processing systems clearly and cleanly capture sound, reproduce sound, and convey sound to other devices. However, audio systems are susceptible to noise sources that can corrupt, mask, or otherwise detrimentally affect signal content.

There are many sources of noise. Wind, rain, background noise such as engine noise, electromagnetic interference, and other noise sources may contribute noise to a signal captured, reproduced, or conveyed to other systems. When the noise level of sound increases, intelligibility decreases.

Some prior systems attempted to minimize noisy signals through multiple microphones. The signals from each microphone are intelligently combined to limit the noise. In some applications, however, multiple microphones cannot be used. Other systems used noise filters to selectively attenuate sound signals. The filters sometimes indiscriminately eliminate or minimize desired signal content as well.

There is a need for a system that enhances signals.

SUMMARY

This invention provides a signal enhancement system that may reinforce signal content and may improve SNR in a signal. The system detects, tracks, and reinforces non-stationary periodic signal components in the signal. The periodic signal components may represent vowel sounds or other voiced sounds. The system also may detect, track, and attenuate quasi-stationary signal components in the signal.

The enhancement system includes a signal input, delay logic, a partitioned adaptive filter, and signal reinforcement logic. The partitioned adaptive filter may track non-stationary fundamental frequency components in the input signal based on a delayed version of the input signal. The partitioned adaptive filter outputs multiple filtered signals. The filtered signals may approximately track and enhance frequency content in the input signal. The reinforcement logic combines the input signal and the filtered signals to produce an enhanced signal. A second adaptive filter may be employed to track and suppress quasi-stationary signal components in the input signal.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The enhancement system detects and tracks one or more fundamental frequency components in a signal. The signal enhancement system reinforces the tracked frequency components. The enhancement system may improve the intelligibility of information in a speech signal or other audio signals. The reinforced signal may have an improved signal-to-noise ratio (SNR).

Figure 1:
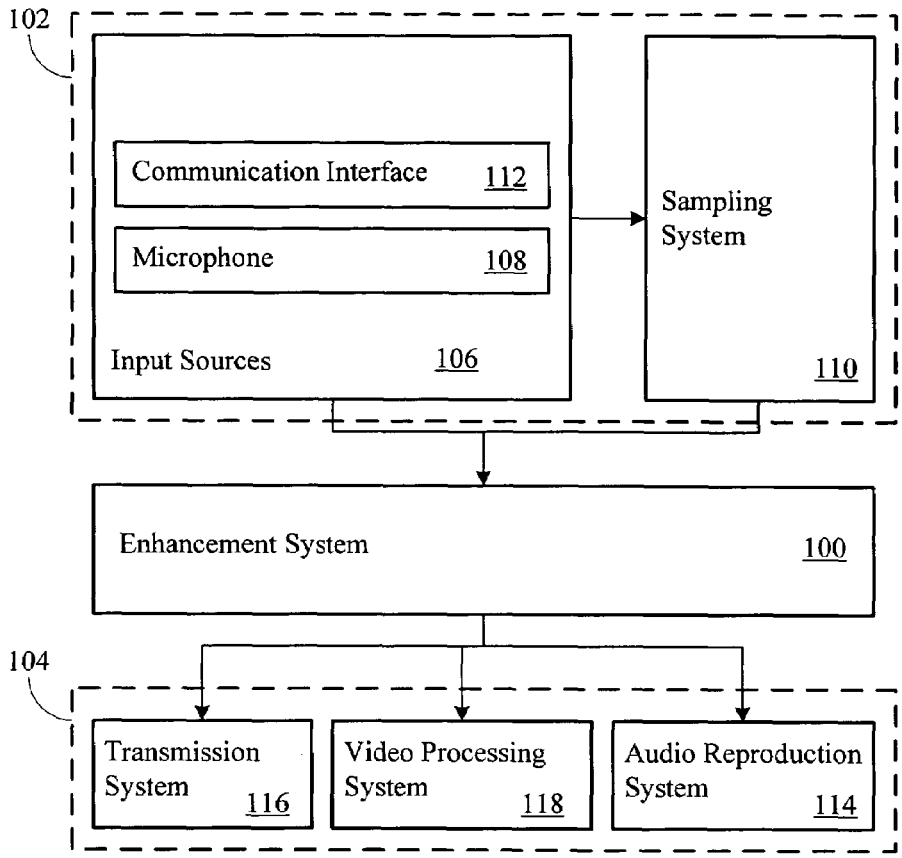
FIG. 1 is a signal enhancement system with preprocessing and post processing logic.

In FIG. 1, a signal enhancement system 100 may operate in conjunction with preprocessing logic 102 and post-processing logic 104. The enhancement system 100 may be implemented in hardware and/or software. The enhancement system 100 may include a digital signal processor (DSP). The DSP may execute instructions that delay an input signal, track frequency components of a signal, filter a signal and/or reinforce spectral content in a signal. Alternatively, the enhancement system 100 may include discrete logic or circuitry, a mix of discrete logic and a processor, or may be distributed over multiple processors or programs.

The enhancement system 100 may accept input from the input sources 106. The input sources 106 may include digital signal sources or analog signal sources such as a microphone 108. The microphone 108 may be connected to the enhancement system 100 through a sampling system 110. The sampling system 110 may convert analog signals sensed by the microphone 108 into digital form at a selected sampling rate.

The sampling rate may be selected to capture any desired frequency content. For speech, the sampling rate may be approximately 8 kHz to about 22 kHz. For music, the sampling rate may be approximately 22 to about 44 kHz. Other sampling rates may be used for speech and/or music.

The digital signal sources may include a communication interface 112, other circuitry or logic in the system in which the enhancement system 100 is implemented, or other signal sources. When the input source is a digital signal source, the enhancement system 100 may accept the digital signal samples with or without additional pre-processing.

The signal enhancement system 100 may also connect to post-processing logic 104. The post-processing logic 104 may include an audio reproduction system 114, digital and/or analog data transmission systems 116, or video processing logic 118. Other post-processing logic also may be used.

The audio reproduction system 114 may include digital to analog converters, filters, amplifiers, and other circuitry or logic. The audio reproduction system 114 may be a speech and/or music reproduction system. The audio reproduction system 114 may be implemented in a cellular phone, car phone, digital media player/recorder, radio, stereo, portable gaming device, or other devices employing sound reproduction.

The video processing system 118 may include circuitry and/or logic that provides a visual output. The signal used to prepare the visual output may be enhanced by the processing performed by the enhancement system 100. The video processing system 118 may control a television or other entertainment device. Alternatively, the video processing system 118 may control a computer monitor or liquid crystal display (LCD).

The transmission system 116 may provide a network connection, digital or analog transmitter, or other transmission circuitry and/or logic. The transmission system 116 may communicate enhanced signals generated by the enhancement system 100 to other devices. In a car phone, for example, the transmission system 116 may communicate enhanced signals from the car phone to a base station or other receiver through a wireless connection such as a ZigBee, Mobile-Fi, Ultrawideband, Wi-fi, or a WiMax network.

Figure 2:
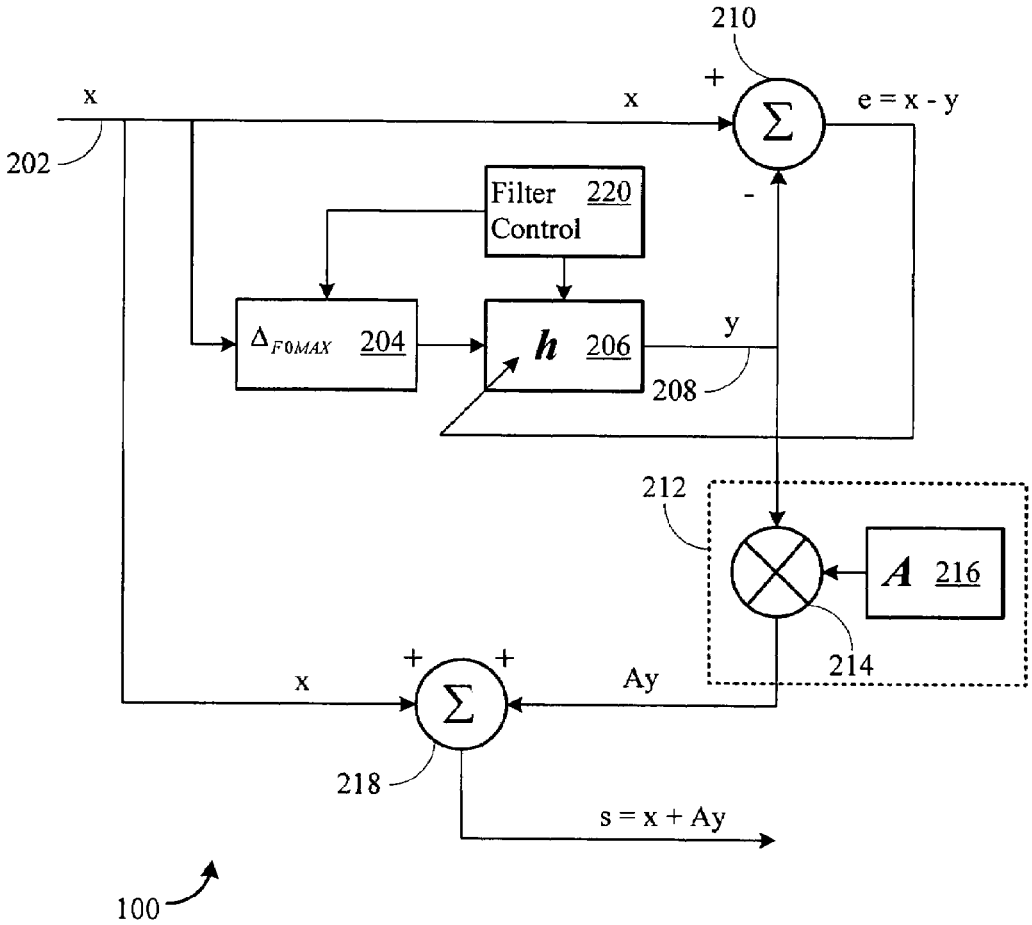
FIG. 2 is a single stage signal enhancement system.

FIG. 2 illustrates the enhancement system 100. The enhancement system 100 includes a signal input 202. The signal input 202 carries an input signal that will be processed by the enhancement system 100. In FIG. 2, the input signal is labeled "x". The input signal may be time domain samples of speech. To facilitate an explanation, speech signals are discussed below. However, the enhancement system 100 may enhance signals with any other range of frequency content, whether audible or inaudible.

The enhancement system 100 may process quasi-stationary or non-stationary signals. Non-stationary signals may vary in their frequency and/or amplitude content relatively quickly over time. Voice is one example of a non-stationary signal.

With few exceptions, even the fundamental frequency component in a speaker's voice changes during speech. The change in fundamental frequency may vary by as much as approximately 50 percent per 100 ms or more. To the human ear, however, the speaker's voice may have a relatively constant pitch.

Quasi-stationary signals change in frequency and/or amplitude less frequently than non-stationary signals. Quasi-stationary signals may arise from machine noise, a controlled human voice, or from other sources. Slowly changing engine noise or alternator whine are examples of quasi-stationary signals.

As shown in FIG. 2, the input signal is coupled to delay logic 204. The delay logic 204 imparts a delay to the input signal. The delay may vary widely depending on the particular implementation of the enhancement system 100. The delay may correspond to a period of a selected maximum pitch. The maximum pitch may be equal to the greatest pitch in the input signal that the enhancement system 100 enhances. The maximum pitch may vary widely depending on the type and characteristics of the input signal.

Speech signals may include a fundamental frequency component from approximately 70 Hz to about 400 Hz. Male speech often includes a fundamental frequency component between approximately 70 Hz to about 200 Hz. Female speech often includes a fundamental frequency component between approximately 200 Hz to about 400 Hz. A child's speech often includes a fundamental frequency component between approximately 250 Hz to about 400 Hz.

The enhancement system 100 may process input signals that include speech from both male and female voices, either separately or simultaneously and overlapping. In these systems, the maximum pitch period may approximately correspond to the period of the fundamental frequency of the female voice. The maximum pitch period may be approximately about 1/300 Hz (approximately 3.3 ms), or may be another pitch period associated with female voice.

Alternatively, the enhancement system 100 may processes speech only from males. In these implementations, the maximum pitch period may correspond to the period of the fundamental frequency of male voice. The maximum pitch period may be approximately 1/150 Hz (approximately 6.6 ms), or may be another pitch period.

The delay logic 204 may delay the input signal by the number of signal samples corresponding to the maximum pitch period. The number of signal samples may be given by:

$$NSS=MPP*f_s$$

where 'NSS' is the number of signal samples, 'MPP' is the maximum pitch period and 'fs' is the sampling rate. Assuming an MPP of about 3.3 ms and a sampling rate of about 8 kHz, NSS=approximately 27 samples. In FIG. 2, NSS corresponds to $\Delta_{F0MAX}$.

The delayed input signal may be received by the filter 206. The filter 206 includes a filter output 208 that carries a filtered output signal, labeled 'y' in FIG. 2. The filter 206 may track one or more frequency components in the input signal based on the delayed input signal. The filter 206 may track the fundamental frequencies in the input signal as the pitch changes during voiced speech.

The filter 206 may reproduce, replicate, approximate or otherwise include the tracked frequency content in the filtered output signal. The filter 206 may be a Finite Impulse Response Filter (FIR) or other type of digital filter. The coefficients of filter 206 may be adaptive. The filter 206 may be adapted by a Normalized Least Mean Squares (NLMS) technique or other type of adaptive filtering technique such as Recursive Least Squares (RLS) or Proportional LMS. Other tracking logic, including other filters may also be used.

The filter 206 may converge to the fundamental frequency in the input signal. The range of fundamental frequencies $f_0$ over which the filter 206 converges may be given by:

$$f_o = f_{0\mathrm{MAX}} - f_{0\mathrm{MIN}}$$

$$f_{0\mathrm{MAX}} = \frac{f_s}{\Delta_{F0\mathrm{MAX}}}$$

$$f_{0\mathrm{MIN}} = \frac{f_s}{\Delta_{F0\mathrm{MAX}} + L}$$

where $\Delta_{F0MAX}$ is the period for the maximum pitch (expressed in terms of samples), $f_s$ is the sampling frequency (in units of Hz), and L is the length of the filter 206 (in units of samples).

The filter length L may increase or decrease to increase or decrease the frequency extent over which the filter 206 tracks frequency components.

In the example above, the maximum pitch was approximately 300 Hz and the delay logic 204 implemented a 27 sample delay. A filter length L of 64 samples yields a filter 206 that tracks fundamental frequency content over a frequency range of approximately 88 Hz to about 296 Hz:

$$f_{0MAX} = \frac{8000}{27} \approx 296$$

$$f_{0MIN} = \frac{8000}{27+64} \approx 88$$

$$f_o \approx 296 - 88 = 208 \text{ Hz}$$

The filter 206 may adapt over time. The filter 206 may quickly adapt by evaluating an error signal 'e' on a sample-by-sample basis. Alternatively, the filter 206 may adapt based on blocks of samples, or other another basis.

In adapting, the filter 206 may change one or more of its filter coefficients. The filter coefficients may change the response of the filter 206. The filter coefficients may adapt the filter 206 so that the filter 206 attempts to minimize the error signal 'e'.

The error estimator 210 may generate the error signal 'e'. The error estimator 210 may be an adder, comparator, or other circuitry or logic. The error estimator 210 may compare the input signal 'x' with the filtered output signal 'y'.

As the filter 206 converges to the fundamental frequency in the input signal, the error signal decreases. As the error signal decreases, the filtered output signal 'y' more closely resembles the input signal 'x' delayed by an integer multiple of the signal's fundamental frequencies. The gain control logic 212 may respond to the error signal.

The optional gain control logic 212 may include a multiplier 214 and a gain parameter 216. The gain control logic 212 may attenuate, amplify, or otherwise modify the filtered output signal. FIG. 2 shows that the gain control logic 212 applies a gain, 'A', to the filtered output signal to produce the gain controlled signal 'Ay'.

The reinforcement logic 218 may reinforce frequency content in the input signal 'x' with the gain controlled signal 'Ay'. The reinforcement logic 218 may be an adder or other circuitry and/or logic. The reinforcement logic 218 may produce the enhanced output signal:

$$s = x + Ay$$

When the error signal increases, the gain control logic 212 may reduce the gain, 'A'. When the gain is reduced, the filtered output signal may contribute less to the enhanced output signal. The relationship between the error signal and the gain may be continuous, stepped, linear, or non-linear.

In one implementation, the enhancement system 100 establishes one or more error thresholds. As the error signal exceeds an upper threshold, the gain control logic 212 may reduce the gain 'A' to 0 (zero). The upper threshold may be set to the input signal so that if e>x, then the gain 'A' may be set to zero. As the error signal falls below a lower threshold, the gain control logic 212 may increase the gain 'A' to 1 (one).

When the error signal exceeds the upper threshold, the filter control logic 220 may reset the filter 206. When the filter 206 is reset, the control logic 220 may zero-out the filter coefficients, re-initialize the filter coefficients, or may take other actions. The control logic 220 may also dynamically modify the filter length, may modify the delay implemented by the delay logic 204, or may modify other characteristics of the enhancement system 100. The control logic 220 also may modify the enhancement system 100 to adapt to changing environments in which the enhancement system 100 is used, to adapt the enhancement system 100 to a new speaker, or other applications.

The filter control logic 220 also may control how quickly the filter 206 adapts, whether the filter adapts, or may monitor or control other filter characteristics. In the context of a system that enhances non-stationary signals, the control logic 220 may expect quickly changing frequency and amplitude components in the input signal. The control logic 220 may also expect or determine over time that particular frequency components in the input signal are prevalent.

The control logic 220 also may determine that the input signal has changed in frequency content, amplitude, or other characteristics from what is expected or from what has been determined. In response, the control logic 220 may stop the filter 206 from attempting to adapt to the new signal content, may slow the rate of adaptation, or may take other actions. The control logic 220 may exercise control over the filter 206 until the input signal characteristics return to what is expected, until a predetermined time has elapse, until instructed to release control, or until another time or condition is met.

The delay logic 204 prevents the filtered output signal from precisely duplicating the current input signal 'x'. Thus, the filtered output signal may closely track the selected periodicities in the input signal 'x'. When the current input signal 'x' is reinforced by the filtered output signal 'y' to produce the output signal 's', periodic signal components may combine constructively and random noise components may combine destructively. Therefore, the periodic signal components may be enhanced more than the noise.

The delay introduced by the delay logic 204 and the filter 206 may be approximately one cycle of a fundamental frequency component tracked by the filter 206. The delay may correspond to the glottal pulse delay for voice sounds, such as vowels. When the filtered output signal is added to the input signal, the delay may allow the fundamental frequency components to add in-phase or approximately in-phase.

When added in-phase, the resulting gain in the fundamental frequency content in the enhanced output signal may be approximately 6 dB or more. The noise in the input signal and the filtered output signal tends to be out of phase. When the input signal and the filtered output signal are added, the noise may increase less than the enhanced frequency content, for example by 3 dB or less. The enhanced output signal may have increased SNR.

The input signal that the enhancement system 100 processes may include multiple fundamental frequencies. For example, when two speakers are speaking at the same time, the input signal may include two non-stationary fundamental frequencies. When multiple fundamental frequencies are present, the filter 206 continues to adapt and converge to provide a filtered out signal 'y' that is a delayed version of the input signal.The reinforcement logic 218 may reinforce one or more of the fundamental frequencies present in the input signal.

Figure 3:
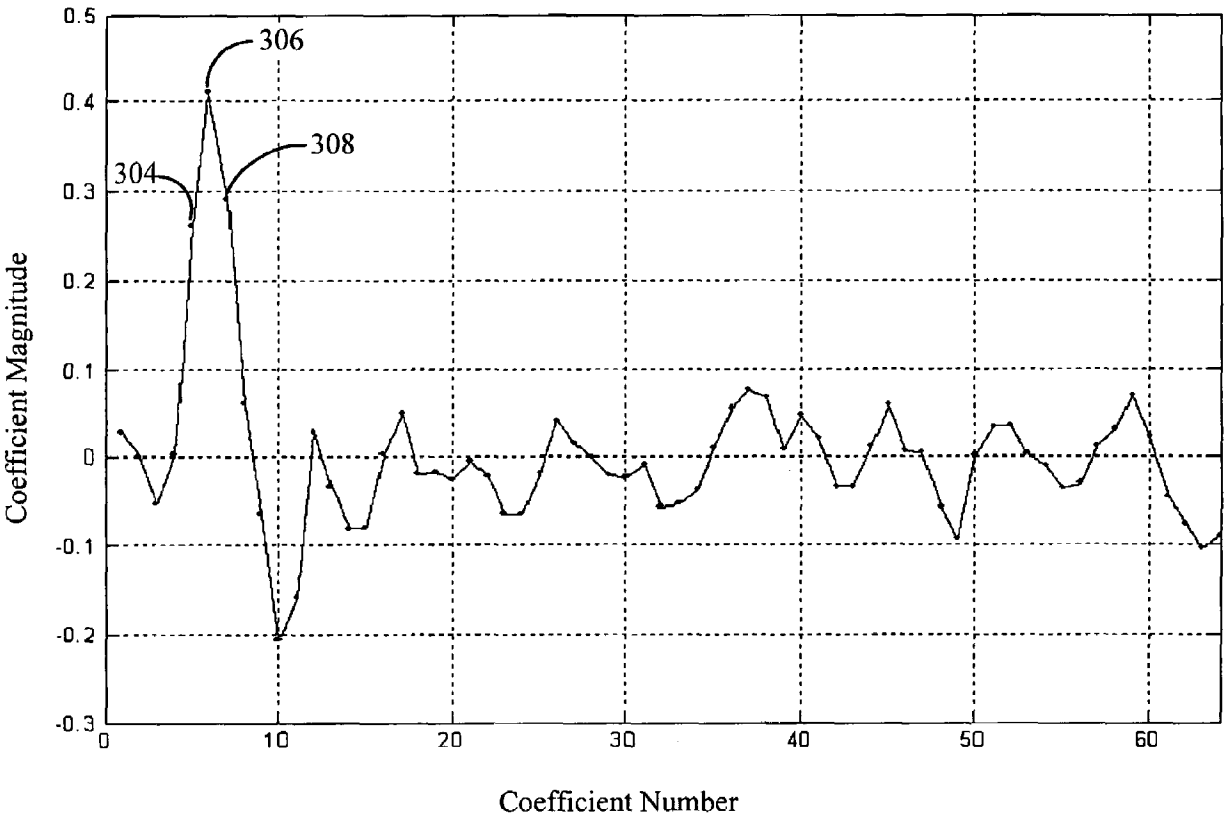
FIG. 3 is a plot of filter coefficients in a filter adapted to a female voice.

In FIG. 3, a plot illustrates coefficients 300 for the filter 206. The coefficients are plotted by coefficient number on the horizontal axis and magnitude on the vertical axis. The coefficients 300 show the filter 206 as it has adapted to female speech.

At any instance in time, the coefficients 300 may be analyzed to determine a fast estimate of the fundamental frequencies in the input signal with good temporal resolution. The coefficients 300 begin to peak around coefficient 304 (the fifth filter coefficient), coefficient 306 (the sixth filter coefficient), and coefficient 308 (the seventh filter coefficient). By searching for a coefficient peak or an approximate coefficient peak, and determining a corresponding coefficient index, 'c', a fast approximation of the fundamental frequency, $f_a$, may be made:

$$f_a = \frac{f_s}{(c + \Delta_{F0MAX})}$$

In FIG. 3, the coefficient peak is at the sixth filter coefficient 306. Assuming an 8 kHz sampling rate and a 27 sample delay:

$$f_a = \frac{f_s}{(c + \Delta_{F0MAX})} = \frac{8000}{6+27} \approx 242\,\text{Hz}$$

Figure 4:
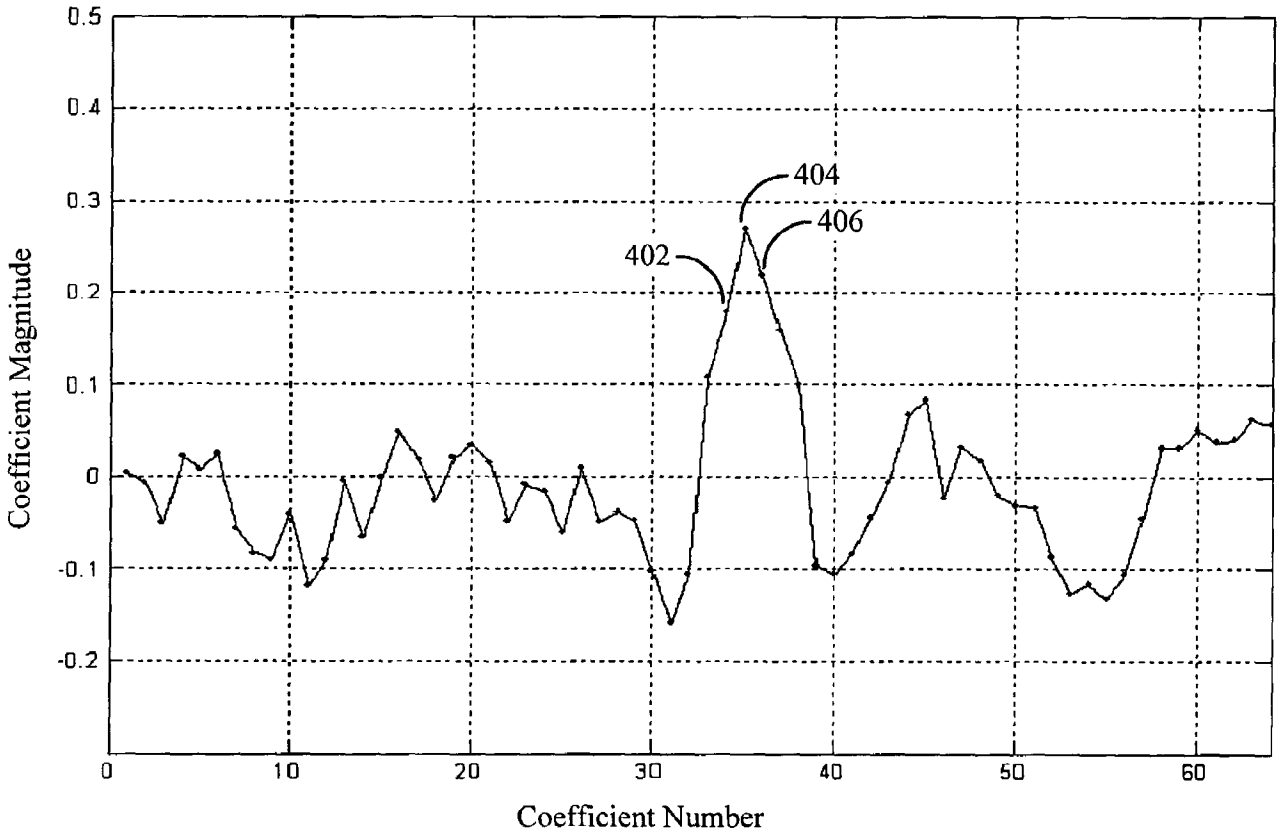
FIG. 4 is a plot of filter coefficients in a filter adapted to a male voice.

In FIG. 4, a plot shows coefficients 400 for the filter 206 as it has adapted to male speech. The coefficient peak appears near coefficient 402 (the 34th filter coefficient), coefficient 404 (the 35th filter coefficient), and coefficient 406 (the 36th filter coefficient). An approximation to the fundamental frequency is:

$$f_a = \frac{f_s}{(c + \Delta_{F0MAX})} = \frac{8000}{35+27} \approx 129\,\text{Hz}$$

The control logic 220 may store historical data on many characteristics of the input signal, including the fundamental frequency of the input signal as it changes over time. The control logic 220 may examine the historical data as an aid in determining whether the characteristics of the input signal have unexpectedly changed. The control logic 220 may respond by exercising adaptation control over the filter 206 or by taking other actions.

Figure 5:
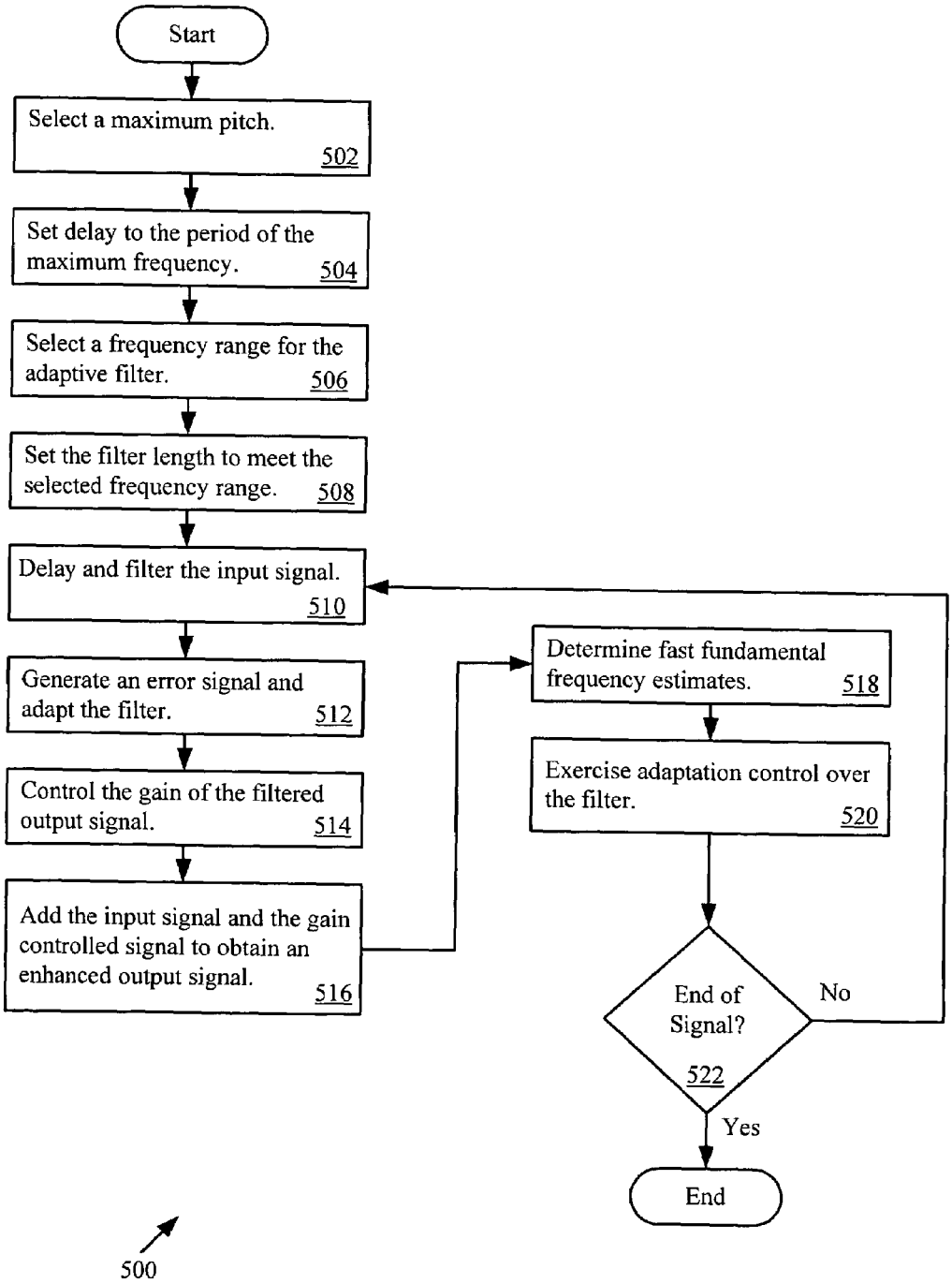
FIG. 5 is a flow diagram of signal enhancement.

FIG. 5 shows a flow diagram 500 of acts that may be taken to enhance a periodic signal. A maximum pitch is selected for processing by the enhancement system 100 (Act 502). The delay logic 204 may be set to implement the period of the maximum pitch (Act 504).

A frequency range over which the enhancement system 100 will operate may also be selected (Act 506). The filter length of the filter 206 may be set to accommodate the frequency range (Act 508). The filter length may be dynamically changed during filter 206 operation.

The input signal is delayed and filtered (Act 510). The enhancement system 100 may generate an error signal and responsively adapt the filter 206 (Act 512). The enhancement system 100 may control the gain of the filtered output signal (Act 514).

The enhancement system 100 may add the input signal and the gain controlled signal (Act 516). An enhanced output signal may result. The enhancement system 100 also may determine fundamental frequency estimates (Act 518). The enhancement system 100 may employ the frequency estimates to exercise adaptation control over the filter 206 (Act 520).

Figure 6:
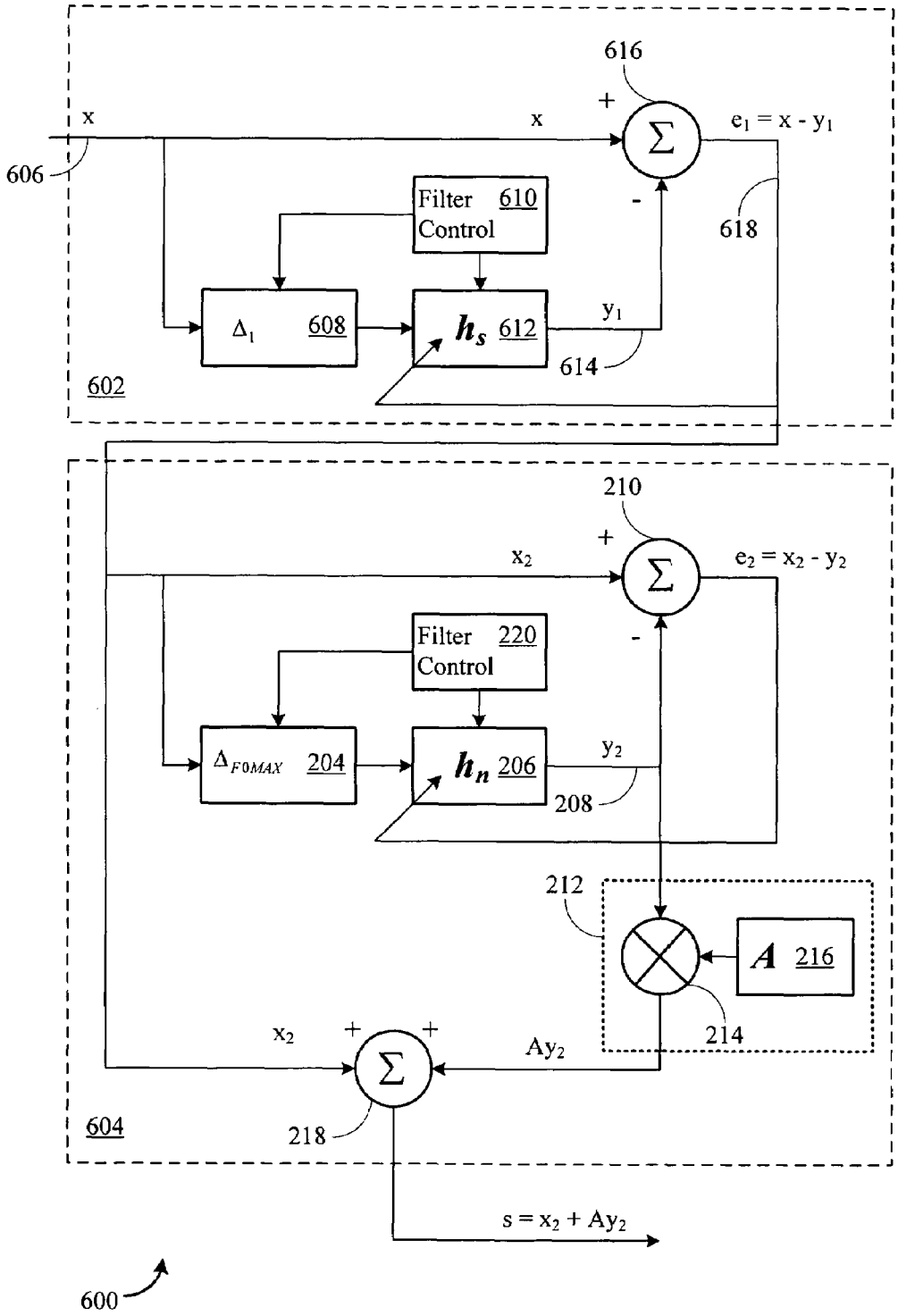
FIG. 6 is a multiple stage signal enhancement system.

FIG. 6 shows a multiple stage enhancement system 600. The enhancement system 600 includes a first filter stage 602 and a second filter stage 604. The filter stages 602 and 604 may respond or adapt at different rates.

The first filter stage 602 may adapt slowly and may suppress quasi-stationary signal components. The quasi-stationary signal components may be present in the input signal because of relatively consistent background noise, such as engine noise or environmental effects, or for other reasons.

A signal input 606 connects to the first stage 602. The signal input 606 may connect to the delay logic 608. The delay logic may implement a delay that corresponds to the period of a maximum quasi-stationary frequency that may be suppressed by the first stage 602.

The maximum quasi-stationary frequency may be selected according to known or expected characteristics of the environment in which the enhancement system 600 is used. The filter control logic 610 may dynamically modify the delay to adapt the first stage 602 to the environment. The filter control logic 610 also may control the quasi-stationary filter 612.

The filter 612 in the first stage may include signal component tracking logic such as a NLMS adapted FIR filter or RLS adapted FIR filter. The filter 612 in the first stage may adapt slowly, for example with a sampling rate of 8 kHz and a filter length of 64 an NLMS step size larger than 0 and less than approximately 0.01 may allow attenuation of quasi-stationary periodic signals while minimally degrading typical speech signals. The first stage filtered output 614 may provide a filtered output signal that approximately reproduces the quasi-stationary signal component in the input signal.

The suppression logic 616 and slow filter adaptation may allow non-stationary signal components to pass through the first stage 602 to the second stage 604. On the other hand, the suppression logic 616 may suppress quasi-stationary signal components in the input signal. The suppression logic 616 may be implemented as arithmetic logic that subtracts the filtered output signal from the input signal.

The replicated quasi-stationary signal content in the filtered output signal is removed from the input signal. The output signal produced by the first stage 602 may be:

$$x_2 = e_1 = x - y_1$$

where '$e_1$' is the first stage output signal, 'x' is the input signal, and '$y_1$' is the first stage filtered output.

The first stage output 618 may be connected to the second stage 604. The second stage 604 may process the signal '$x_2$' with the adaptive filter 206. The filter 206 may adapt quickly, for example with a sampling rate of 8 kHz and a filter length of 64 an NLMS step size larger than approximately 0.6 and less than 1.0 may allow the adaptive filter 206 to track the fundamental frequencies in typical speech signals.

The second stage 604 may enhance non-stationary signal components in the first stage output signal. The non-stationary signal components may be present in the input signal as a result of speech, music, or other signal sources. The second stage 604 may process the first stage output signal as described above.

The enhancement system 600 employs a first suppression stage 602 followed by a second enhancement stage 604. The enhancement system 600 may be employed to reinforce non-stationary signal content, such as voice content. In environments that introduce slowly changing signal components, the enhancement system 600 may remove or suppress the slowly changing signal components. In a car phone, for example, the first stage 602 may remove or suppress engine noise, road noise, or other noises, while the second stage 604 enhances non-stationary signal components, such as male or female voice components.

The signal enhancement system 100 may enhance periodic signal content, increase SNR, and/or decrease noise in an input signal. When applied to a voice signal, the enhancement system 100 may reinforce fundamental speech frequencies and may strengthen vowel or other sounds. The enhancement system 100 may enhance other signals, whether they are audible or inaudible.

The overall delay introduced by the delay logic 204 or 608 and the filter 206 or 612 also may be approximately an integer number (one or greater) of cycles of the tracked pitch period. Delaying by additional cycles may allow the input signal to change to a greater degree than waiting one cycle. Adding the longer delayed filtered signal to the current input signal may produce special effects in the output signal such as reverberation, while still enhancing fundamental frequency components.

Figure 7:
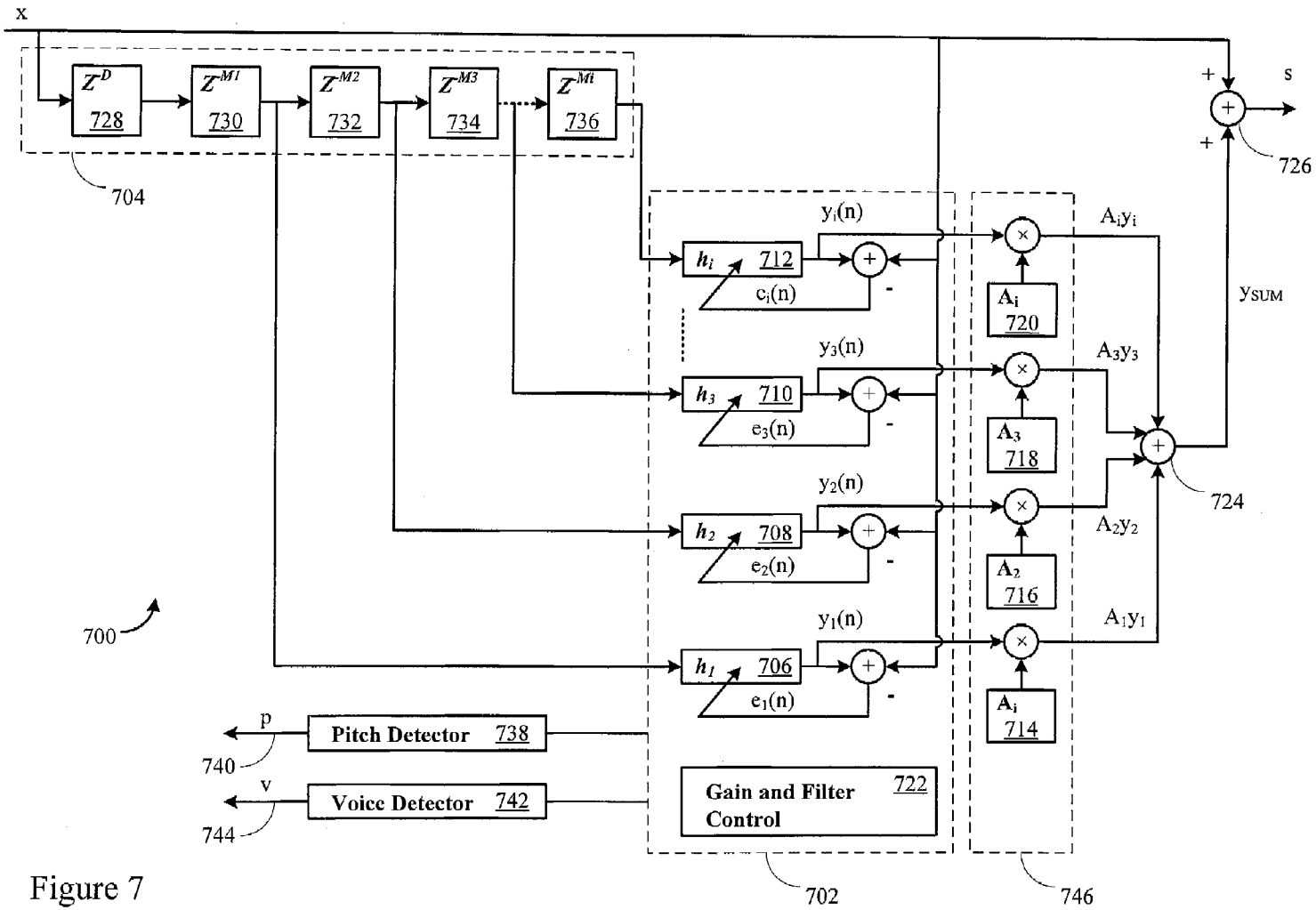
FIG. 7 is a signal enhancement system including a partitioned adaptive filter.

In FIG. 7, a signal enhancement system 700 includes a partitioned adaptive filter 702 as well as partitioned delay logic 704. The partitioned adaptive filter 702 includes multiple adaptive filters, illustrated in FIG. 7 as adaptive filters 1 through 'i'. The adaptive filters 1, 2, 3, and 'i' are labeled 706, 708, 710, and 712, respectively. The output of each adaptive filter may connect to gain logic 746 including multipliers that apply fixed or variable gain parameters to the filter outputs. FIG. 7 illustrates gain parameters 714, 716, 718, and 720 individually applied to the outputs of the filters 706-712. The gain and filter control logic 722 may exercise control over the gain parameters 714-720 and filter adaptation for each individual filter 706-712.

One or more of the gain weighted filter outputs may be added together by the reinforcement logic 724 to obtain a weighted sum of the filter outputs, '$y_{SUM}$'. The reinforcement logic 726 adds the weighted summed filter outputs '$y_{SUM}$' to the input signal 'x' to create the output signal 's'. The reinforcement logic may be an adder or other signal summer. The partitioned delay logic 704 includes multiple series-connected delay blocks, five of which are labeled as delay blocks 728, 730, 732, 734, and 736.

Each filter 706-712 receives the input signal 'x' after it has been delayed by the partitioned delay logic 704 and determines an individual error signal 'e' for that filter based on 'x' and that filter's output signal 'y'. For example, the error signal 'e' for the first adaptive filter 706 is '$e_1$'='x'−'$y_1$'. Each adaptive filter 706-712 adapts in an effort to minimize its individual error signal '$e_i$'.

The partitioned filter 702 divides the entire signal tracking task across multiple adaptive filters 706-712. Each adaptive filter 706-712 may process and adapt a portion of the overall impulse response of the partitioned filter 702. As a result, each adaptive filter 706-712 may have a smaller length (e.g., a smaller number of taps) than the longer adaptive filter shown in FIG. 2.

Given an impulse response implemented with 120 taps and six adaptive filters, each adaptive filter may process 20 (or any other number) taps of the overall impulse response. In another implementation, the number of adaptive filter partitions in the filter 702 is equal to the length of the overall impulse response, and therefore each adaptive filter has length 1. The overall length of the partitioned filter 702 may be chosen as explained above with respect to the range of frequencies that the partitioned filter 702 will track.

The adaptive filters 706-712 may vary in length depending on the expected fundamental frequencies in an input signal. For processing the portion of the impulse response at or around the expected fundamental frequency, the adaptive filters 706-712 may be partitioned into shorter, more quickly adapting filters. Away from the expected fundamental frequency, the adaptive filters 706-712 may be longer more slowly adapting filters. Thus, the lengths of the adaptive filters 706-712 may be selected to provide fast adaptation at or around frequencies of interest in the input signal.

Each adaptive filter 706-712 individually uses fewer filter coefficient updates. The adaptive filter 706-712 may update more quickly than filters in an implementation employing longer adaptive filters. Faster filter updates yield enhanced overall tracking performance, particularly at higher frequencies. The increase in overall tracking performance lends itself to tracking fundamental frequencies that change quickly, whether those frequencies are voiced or are artificially created. A least-mean-square (LMS) algorithm, a recursive-least-square (RLS) algorithm, variants of the LMS RLS, or other techniques may be employed to update the filter coefficients based on the individual error signals '$e_i$'.

The delay logic 704 delays the arrival of the input signal 'x' to one or more of the filters 706-712. FIG. 7 shows that each filter 706-712 is associated with its own delay. Each delay block 728-736 may implement a delay of any number of signal samples.

One implementation uses an initial delay of D samples in the first delay block 728. Each subsequent delay logic 730-736 has an individually configurable delay, shown in FIG. 7 as delays of M1, M2, M3, and Mi samples. The delay block 730 feeds the first adaptive filter 706, the delay block 732 feeds the second adaptive filter 708, the third delay block 734 feeds the third adaptive filter 710, and so on up to the $i^{th}$ delay block 736 that feeds the $i^{th}$ filter 712.

The delays D, M1, . . . , Mi may each be the same or may each be different. The delays M1, . . . , Mi may correspond to the length (e.g., the number of taps) of the adaptive filter which the delay block feeds, or may be different from the length of the adaptive filter which the delay block feeds. For example, the length of the adaptive filter 710 may be M3 taps and the delay block 734 that feeds the adaptive filter 706 may delay signal samples by M3 samples.

When the length of an adaptive filter 'i' is less than its associated delay Mi, the adaptive filter may initially converge faster. When the length of an adaptive filter 'i' is greater than its associated delay Mi, the adaptive filter may experience a smaller mean squared error upon convergence. The filter lengths and/or delay logic 730-736 may be set according to the implementation guidelines for the implementation in which the system 700 is employed.

The delay D may be chosen to set a range of fundamental frequencies over which the system 700 will adapt. The range of fundamental frequencies $f_0$ or pitches over which the filter 700 converges or adapts is given by:

$$f_o = f_{0MAX} - f_{0MIN}$$

$$f_{0MAX} = \frac{f_s}{D}$$

$$f_{0MIN} = \frac{f_s}{D+L}$$

where L is the length of the overall partitioned adaptive filter 702, e.g., L=M1+M2+ . . . +Mi, and $f_s$ is the sampling rate.

The gain and filter control logic 722 may exercise control over the gains 714-720 and filter adaptation on an individual basis, i.e., for each individual filter 706-712. The control techniques described above with respect to the filter control 220 may also be employed in the signal enhancement system 700. The gains 714-720 may be proportional to, or may be otherwise set based on the signal to noise ratio of the input signal 'x'. As SNR decreases, one or more of the gains 714-

720 may increase in an attempt to suppress the noise. As SNR increases, one or more of the gains 714-720 may decrease or may be set to zero.

The gains 714-720 may be determined as a function of the filter coefficients of its corresponding adaptive filter, or in other ways. One expression for the gains 714-720, optionally including a normalizing constant 'k' is:

$$A_i = f(h_i)/k$$

The function $f(h_i)$ is a function of the adaptive filter coefficients and may be defined in many ways depending on the enhancement desired. Examples of $f(h_i)$ are given below:

$$f(h_i) = \max_n |h_i(n)| \quad (1)$$

$$f(h_i) = \max_n |h_i(n)|^2 \quad (2)$$

$$f(h_i) = \frac{\sum_n h_i(n) + \sum_n |h_i(n)|}{2} \quad (3)$$

$$f(h_i) = \frac{\max_n |h_i(n)| + \max_n h_i(n)}{2} \quad (4)$$

$$f(h_i) = \left[\frac{\max_n |h_i(n)| + \max_n h_i(n)}{2}\right]^m, m > 0 \quad (5)$$

In one implementation, equation (5) is employed with m=2 and a filter length of 1. Increasing 'm' may provide greater enhancement of harmonics. The gains 714-720 may be selected or determined based on other information in addition to or as an alternative to the filter coefficients. The normalizing constant 'k' may be set according to:

$$k = \max_i(f(h_i))$$

The gains 714-720 may be selected or modified (e.g., increased) to amplify the effect of an adaptive filter with coefficients that will enhance or strengthen periodic components of the input signal. The gains 714-720 may also be selected or modified (e.g., reduced or set to zero) to reduce or eliminate the effect of an adaptive filter with coefficients (generally negative coefficients) that would degrade or weaken periodic components of the input signal. The gains 714-720 may be set in other ways that depend on the magnitude of the filter coefficients, however. Accordingly, the enhancement system 700 may set the gains 714-720 on an individual basis such that only enhancement occurs in the system 700.

The reinforcement logic 726 produces the enhanced output signal 's':

$$s = x + A_1 y_1 + A_2 y_2 + A_3 y_3 + \ldots + A_i y_i$$

Figure 8:
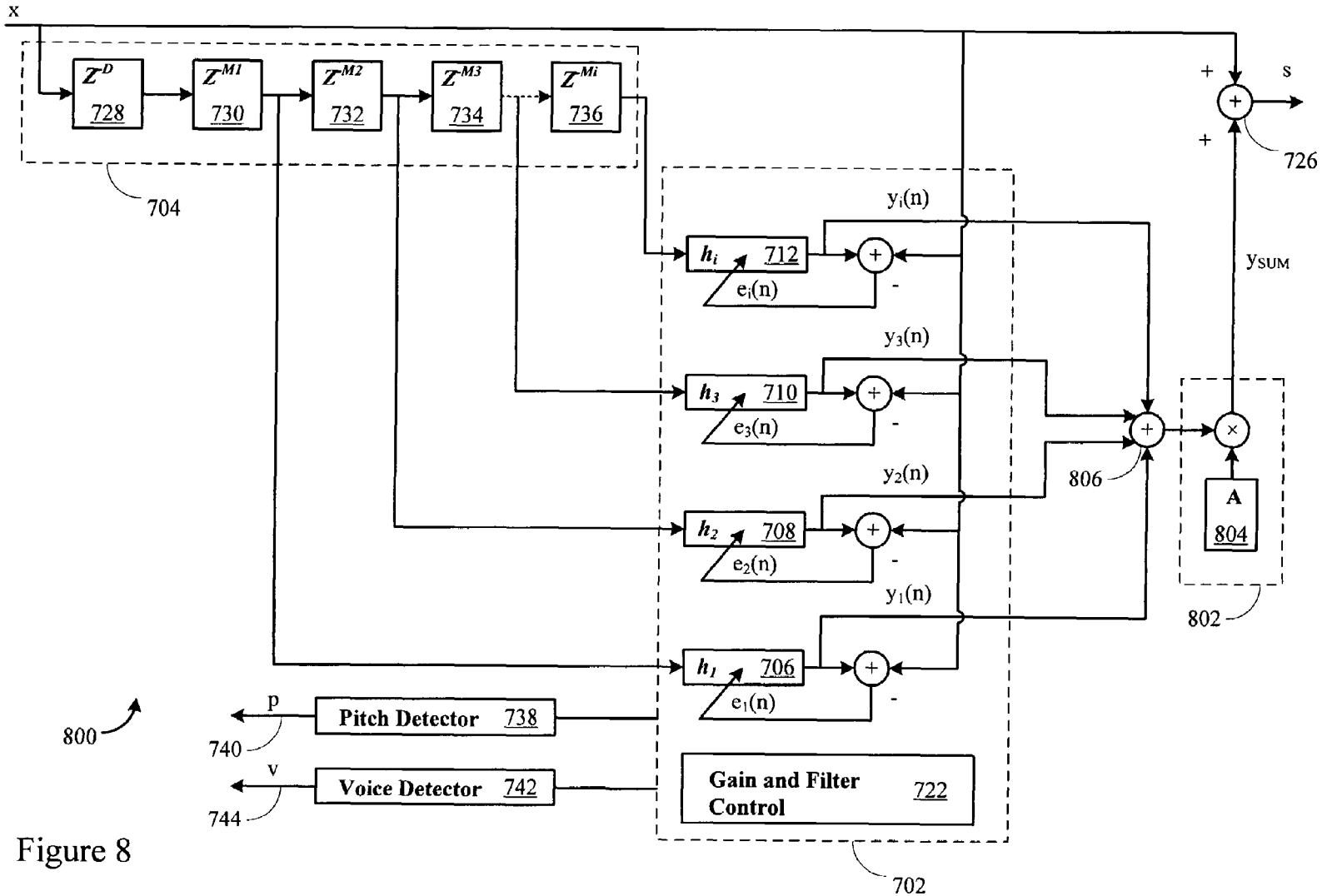
FIG. 8 is an alternative implementation of a signal enhancement system including a partitioned adaptive filter.

FIG. 8 shows an enhancement system 800 that provides an alternative to the enhancement system 700. The enhancement system 800 replaces the individually controlled gains 714-720 with the gain logic 802, e.g., a multiplier and a gain parameter. The gain logic 802 biases the sum of the adaptive filter outputs by the gain parameter 'A' 804. The reinforcement logic 806 may provide a sum of each adaptive filter output.

The signal 's' generated by the enhancement systems 700 and 800 includes strengthened fundamental frequencies and harmonics of the fundamental frequencies, resulting in a more intelligible audio signal. Each adaptive filter 706-712 in the enhancement systems may be updated independently by its own error signal, leading to faster adaptation for the filter and overall. The division into multiple adaptive filters thereby leads to decreased smearing between adjacent harmonics, better preservation of smaller harmonics (e.g., harmonics close to the noise level), and less distortion of non-periodic components of the input signal. Moreover, the enhancement system 700 may enhance even harmonics embedded in noise to levels above the noise, and may preserve small harmonics better. In selecting between implementations, the enhancement system 800 has the advantages of reduced complexity and reduced computational requirements, while the enhancement system 700 has the advantage of providing the flexibility to independently control the gain of each adaptive filter 706-712 and its influence on the output signal.

Figure 9:
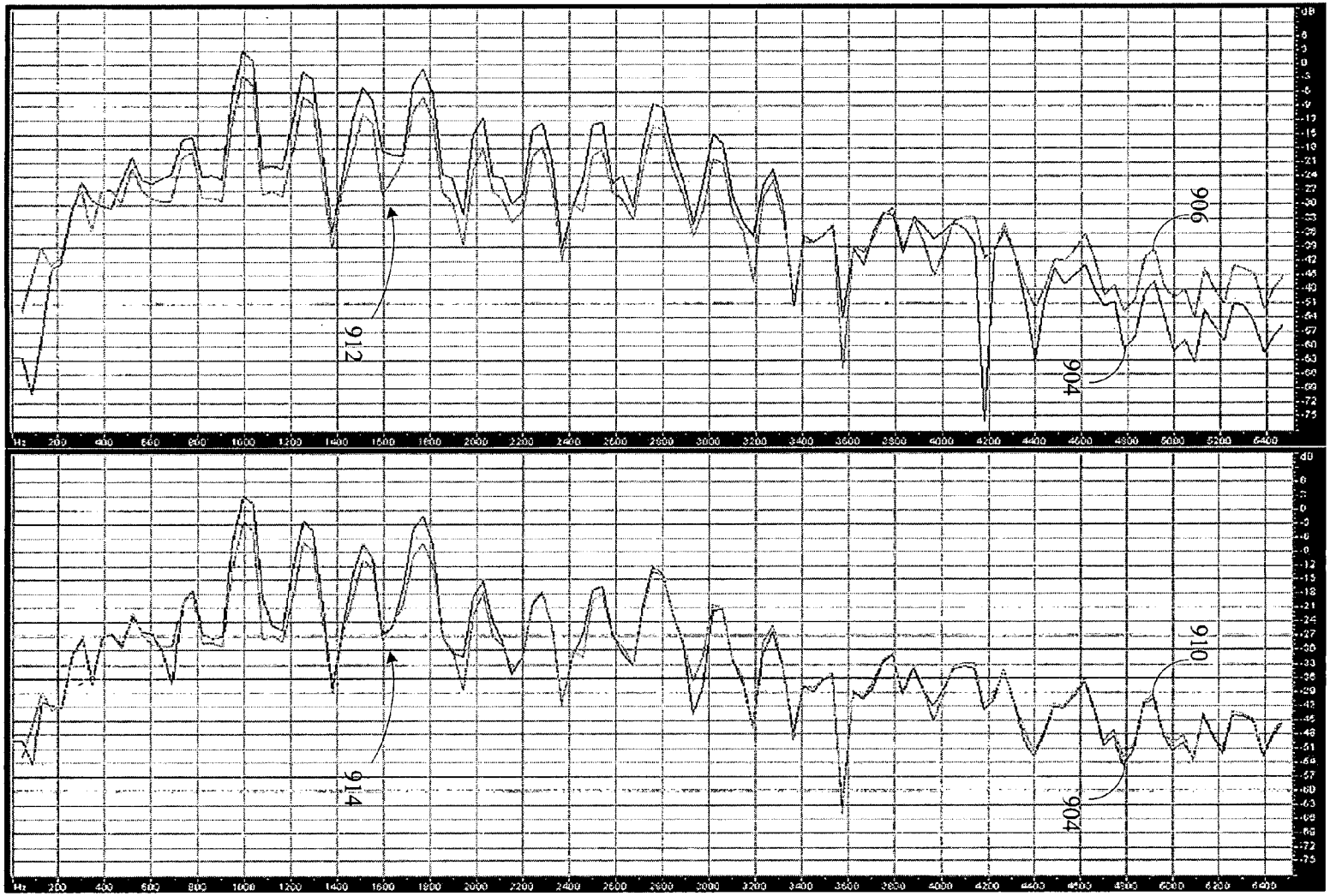
FIG. 9 is a comparison of frequency performance of signal enhancement systems shown in FIGS. 2 and 8.

FIG. 9 is a comparison of frequency performance of the signal enhancement systems 200 and 800. The plot 902 illustrates the performance of the signal enhancement system 200, including input signal 904 and output signal 906. The plot 908 illustrates the performance of the signal enhancement system 800, including the same input signal 904 and enhanced output signal 910. The plot 908 shows the improved overall tracking response of the enhancement system 800 over the signal enhancement system 200, including improved high frequency response. The output signal 910 much more closely tracks the high frequency content of the input signal 904.

The plots 902 and 908 also show the improved separation between harmonics achieved by the enhancement system 800. Plot 902 shows the frequency response gap 912 between the input signal 904 and the enhanced signal 906. The plot 908 of the performance of the enhancement system 800 shows that the gap is far smaller, as indicated at reference numeral 914. The output signal 910 has improved separation between harmonics, leading to less smearing between the harmonics in the output signal 910.

Figure 10:
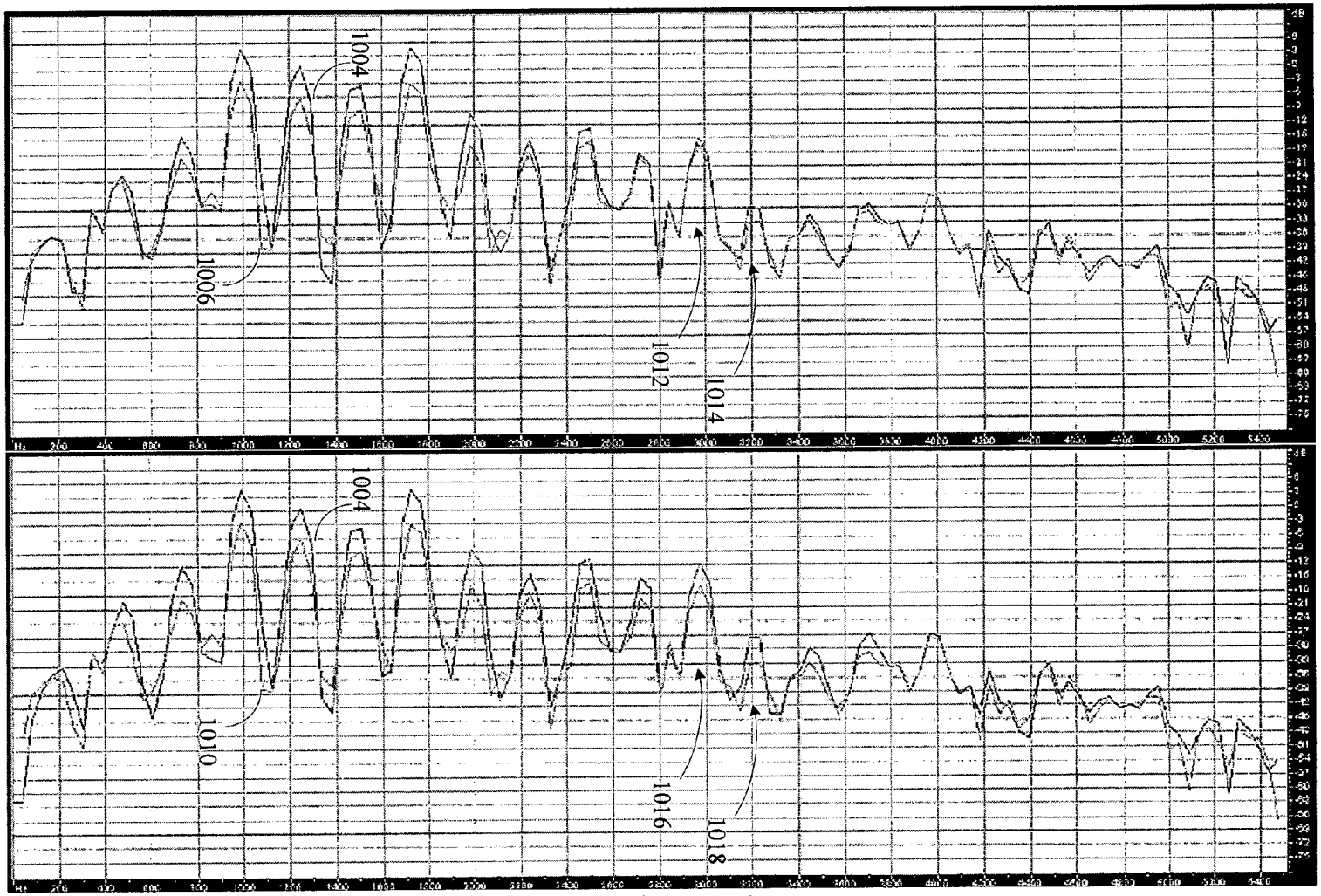
FIG. 10 is a comparison of frequency performance of signal enhancement systems shown in FIGS. 7 and 8.

FIG. 10 is a comparison of frequency performance of the signal enhancement systems 700 and 800. The plot 1002 illustrates the performance of the signal enhancement system 800, including the input signal 1004 and output signal 1006 generated by the enhancement system 800. The plot 1008 illustrates the performance of the signal enhancement system 700, including the same input signal 1004 and output signal 1010. The plot 1008 shows the improved overall tracking response of the enhancement system 700 (with individually controlled gains 714-720), including improved enhancement of smaller harmonics.

Examples of enhanced smaller harmonics 1012, 1014, 1016, and 1018 are labeled in FIG. 10. The enhanced harmonics 1012 and 1014 are located at approximately 3000 and 3200 Hz in the plot 1002 and were strengthened by the enhancement system 800. The enhancement system 700 provides even greater enhancement of smaller harmonics as indicated by the enhanced harmonics 1016 and 1018 in plot 1008.

Figure 11:
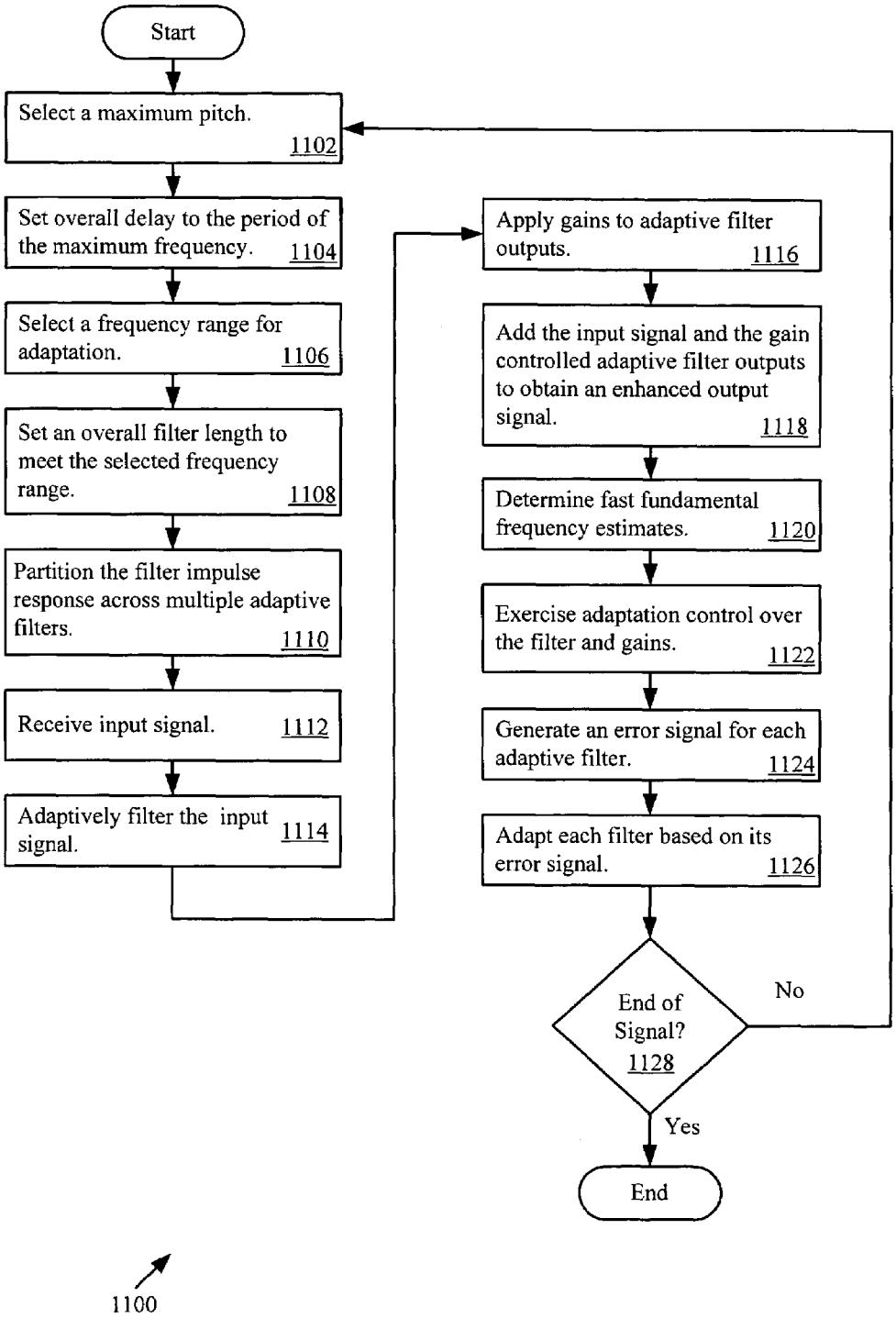
FIG. 11 is a flow diagram of signal enhancement.

FIG. 11 shows a flow diagram 1100 of acts that may be taken to enhance a periodic signal. A maximum pitch that the enhancement systems 700, 800 will track is selected (Act 1102). The pitch may be chosen according to the type of signals expected to be encountered and their characteristics, such as male, female, or child voice characteristics. The overall delay implemented by the delay blocks 728-736 may be set to the period of the maximum pitch (Act 1104).

A frequency range over which the enhancement systems 700, 800 will operate may also be selected (Act 1106). The overall filter length of the adaptive filters 702-708 may be set to accommodate the frequency range (Act 1108). The filter length, frequency range, and maximum pitch may be dynamically changed during enhancement system operation.

The enhancement system partitions the overall impulse response across multiple adaptive filters 706-712 (Act 1110).

The adaptive filter may be partitioned into smaller blocks at portions where the magnitude of the impulse response of the fundamental frequency of interest is high. Any adaptive filter 706-712 may process one or more points of the impulse response. Each adaptive filter 706-712 may process the same or different number of points of the impulse response.

The enhancement systems 700 and 800 receive an input signal (Act 1112). The enhancement systems 700 and 800 filter the input signal using the partitioned adaptive filter (Act 1114). Individually selected gains are applied to the filtered output signal of each adaptive filter (Act 1116). The gain controlled output signals are then summed. Alternatively, a gain may be applied to the sum of one or more filtered output signals. The enhancement systems 700, 800 add the input signal and the gain controlled output signals (Act 1118). An enhanced output signal results, with strengthened fundamental frequency and harmonic content.

The enhancement systems 700 and 800 may incorporate pitch detection logic 738 including a pitch estimate output 'p' 740. The pitch detection logic 738 may determine fundamental frequency estimates of signal components of the input signal (Act 1120) as described above. The estimates may be based on an analysis of the filter coefficients across each adaptive filter 706-712 to quickly estimate the fundamental frequency. The frequency estimates or other information may provide a basis for the enhancement systems 700 and 800 to exercise adaptation control over the filters 706-712 and gains (Act 1122), such as increasing or decreasing adaptation rate, changing the filter lengths, adding or removing filters, and other adaptations.

The enhancement systems 700 and 800 may also include voice detection logic 742 including a voice detection output 'v' 744. The voice detection logic 742 may locate peaks in the filter coefficients that are above a pre-selected threshold (e.g., the background noise level). Such coefficients may indicate the presence of a periodic frequency component in the input signal. Vowel sounds may give rise to coefficient peaks above the background noise level that may be particularly strong peaks. The voice detection logic 742 may assert the voice detection output 'v' when peaks above the threshold are present, indicating that an input signal includes a voiced component.

The voice detection logic 742 may determine a detection measure. The detection measure provides an indication of whether voice is present in the input signal. The detection measure may be a sum of magnitudes of positive filter coefficients. When the sum exceeds a threshold, the voice detection logic may assert the voice detection output 'v' 744.

Each adaptive filter 702-708 generates its own error signal (Act 1124). Each adaptive filter 706-712 thereby adapts based on its own error signal (Act 1126). The enhancement systems 700, 800 may continue to provide an enhanced output signal for the duration of the input signal (Act 1128).

Figure 12:
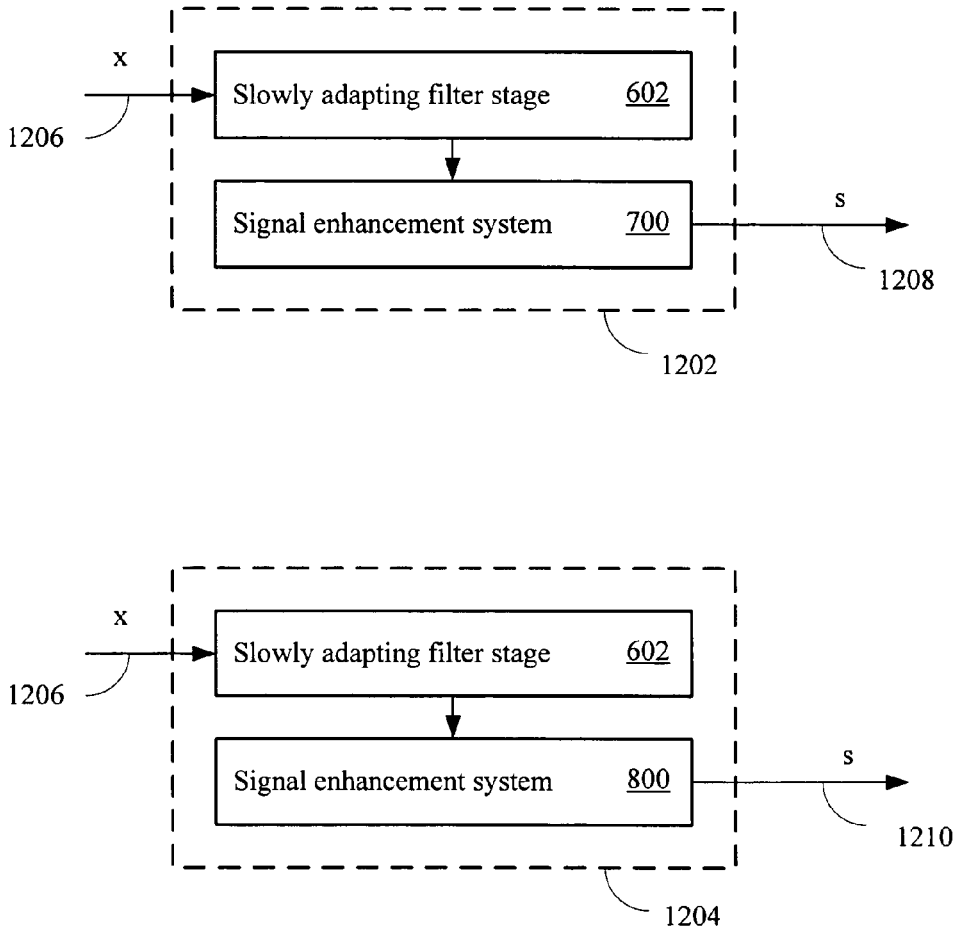
FIG. 12 are multiple stage signal enhancement systems.

FIG. 12 shows a multiple stage enhancement system 1202 and a multiple stage enhancement system 1204. The system 1202 includes a slowly adapting filter stage (e.g., stage 602) coupled to the signal enhancement system 700. The input signal 'x' 1206 is coupled to the slowly adapting filter stage 602, and the signal enhancement system 700 produces the enhanced output signal 's' 1208. The multiple stage enhancement system 1204 employs a slowly adapting filter stage 602 that is coupled to the signal enhancement system 800, generating an enhanced output signal 's' 1210.

The slowly adapting filter stage 602 may suppress quasi-stationary signal components. The quasi-stationary signal components may be present in the input signal because of background noise with slowly varying frequency content. The slowly adapting filter stage 602 may suppress engine noise, environmental effects, or other noise sources with relatively slowly changing frequency characteristics. The signal enhancement systems 700, 800 follow to enhance periodic frequency content, such as that present in a voice signal, that passes through the slowly adapting filter stage 602.

The signal enhancement systems 200, 600, 700, and 800 may be implemented in hardware, software, or a combination of hardware and software. The enhancement systems may take the form of instructions stored on a machine readable medium such as a disk, EPROM, flash card, or other memory. The enhancement systems 200, 600, 700, and 800 may be incorporated into communication devices, sound systems, gaming devices, signal processing software, or other devices and programs. The enhancement systems 200, 600, 700, and 800 may pre-process microphone input signals to enhance SNR of vowel sounds for subsequent processing.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A signal enhancement system comprising:
- a signal input;
- partitioned delay logic coupled to the signal input;
- a partitioned adaptive filter coupled to the partitioned delay logic and comprising multiple adaptive filter outputs;
- filter reinforcement logic coupled to the adaptive filter outputs;
- gain logic coupled to the filter reinforcement logic; and
- signal reinforcement logic comprising circuitry, program instructions stored in memory, or both, where the signal reinforcement logic is coupled to the signal input and the gain logic and comprising an enhanced signal output.

2. The signal enhancement system of claim 1, where the multiple filter outputs comprise a first filter output and a second filter output, and where the partitioned adaptive filter comprises:
- a first adaptive filter comprising:
  - first filter coefficients;
  - the first filter output; and
  - a first error output;
- a second adaptive filter comprising:
  - second filter coefficients;
  - the second filter output; and
  - a second error output,
- wherein the first filter coefficients are adapted based on the first error output and the second filter coefficients are adapted based on the second error output.

3. The signal enhancement system of claim 2, where the first error output comprises a first difference between the signal input and the first filter output, and where the second error output comprises a second difference between the signal input and the second filter output.

4. The signal enhancement system of claim 2, where delay logic comprises an M1 sample delay coupled to the first adaptive filter and an M2 sample delay coupled to the second adaptive filter.

5. The signal enhancement system of claim 4, where the M2 sample delay is in series with the M1 sample delay.

6. The signal enhancement system of claim 4, where the first adaptive filter is a length M1 adaptive filter and where the second adaptive filter is a length M2 adaptive filter.

7. The signal enhancement system of claim 6, where M1=M2.

8. The signal enhancement system of claim 6, where M1=M2=1.

9. The signal enhancement system of claim 4, where the first filter has a length smaller than M1 or the second filter has a length smaller than M2.

10. The signal enhancement system of claim 4, where the first filter has a length greater than M1 or the second filter has a length greater than M2.

11. The signal enhancement system of claim 1, where the delay logic comprises a D sample delay selected to set a maximum adaptation pitch.

12. The signal enhancement system of claim 1, where the delay logic comprises an L sample delay selected to set an adaptation pitch range.

13. The signal enhancement system of claim 1, where the delay logic implements an adaptation pitch range including a human voice pitch.

14. The system of claim 1, where the delay logic implements an adaptation pitch range between approximately 70 Hz and approximately 400 Hz.

15. The system of claim 1, further comprising a first stage filter comprising quasi-stationary frequency tracking and attenuation logic, where the first stage filter is coupled between the signal input and to the delay logic.

16. The signal enhancement system of claim 1, where the signal reinforcement logic adds an output of the gain logic to a signal received at the signal input to generate an enhanced signal output with reinforced periodic signal content.

17. A signal enhancement system comprising:

means for receiving an input signal;

means for delaying the input signal by multiple different delays;

means for partitioned adaptive filtering the input signal based on the multiple different delays; and means for reinforcing the input signal with a partitioned adaptive filtering output.

18. The signal enhancement system of claim 17, further comprising:

means for tracking and filtering a quasi-stationary signal in the input signal prior to filtering the input signal.

19. The signal enhancement system of claim 17, further comprising means for adapting the means for partitioned adaptive filtering based on multiple error signals.

20. The signal enhancement system of claim 17, further comprising:

means for biasing the partitioned adaptive filtering output.

21. The signal enhancement system of claim 17, where the means for reinforcing comprises means for adding the partitioned adaptive filtering output to the input signal to generate an enhanced signal output with reinforced periodic signal content.

22. A signal enhancement system comprising:

a signal input;

an M1 sample delay coupled to the signal input;

an M2 sample delay coupled to the M1 sample delay;

a first adaptive filter coupled to the M1 sample delay and comprising a first filter output;

a second adaptive filter coupled to the M2 sample delay and comprising a second filter output;

filter reinforcement logic connected to the first filter output and the second filter output; and signal reinforcement logic comprising circuitry, program instructions stored in memory, or both, where the signal reinforcement logic is connected to the signal input and the filter reinforcement logic.

23. The signal enhancement system of claim 22, where M1=M2.

24. The signal enhancement system of claim 22, where M1=M2=1.

25. The signal enhancement system of claim 22, further comprising an initial D sample delay coupled to the M1 sample delay, where 'D' is chosen to set a maximum adaptation pitch.

26. The signal enhancement system of claim 25 where the D sample delay, the M1 sample delay, and the M2 sample delay implement an adaptation pitch range including that of human voice.

27. The signal enhancement system of claim 25 where the D sample delay, the M1 sample delay, and the M2 sample delay implement an adaptation pitch range between approximately 70 Hz and approximately 400 Hz.

28. The signal enhancement system of claim 22, further comprising a gain logic coupled to the filter reinforcement logic.

29. The signal enhancement system of claim 22, further comprising a slowly adapting first stage filter coupled to the signal input.

30. The signal enhancement system of claim 29, where the first stage filter comprises quasi-stationary signal tracking and attenuation logic.

31. The signal enhancement system of claim 22, where the first adaptive filter comprises a first error output based on the input signal and the first filter output, and where the first adaptive filter comprises first coefficients adapted based on the first error output.

32. The signal enhancement system of claim 31, where the second adaptive filter comprises a second error output based on the input signal and the second filter output, and where the second adaptive filter comprises second coefficients adapted based on the second error output.

33. The signal enhancement system of claim 22, where the signal reinforcement logic adds the first filter output and the second filter output to a signal received at the signal input to generate an enhanced signal output with reinforced periodic signal content.

34. A method for enhancing a signal, comprising:

receiving an input signal comprising a fundamental frequency;

delaying the input signal by multiple different sample delays to obtain multiple differently delayed input signals;

applying a partitioned adaptive filter comprising multiple individual adaptive filters to the multiple differently delayed input signals;

generating a filtered output with the partitioned adaptive filter, the filtered output approximately delayed by an integer multiple of the fundamental frequency;

generating an error signal for each of the multiple individual adaptive filters;

adapting each of the individual adaptive filters based on the error signal for that individual adaptive filter; and reinforcing the input signal with the filtered output.

35. The method of claim 34, further comprising:

forming a sum of outputs of the multiple adaptive filters;

biasing the sum by a gain parameter.

36. The method of claim 34, further comprising:

determining a maximum pitch to track;

and where delaying the input signal comprises delaying the input signal by D samples, where D is selected according to the maximum pitch.

37. The method of claim 36, further comprising:

selecting a pitch tracking range;

and where delaying the input signal comprises delaying the input signal by D+L samples, where L is selected to set the pitch tracking range.

38. The method of claim 37, where the pitch range includes a human voice pitch.

39. The method of claim 37, where the pitch range extends between approximately 70 Hz and approximately 400 Hz.

40. The method of claim 34, where reinforcing comprises adding the filtered output to the input signal to generate an enhanced signal output with reinforced periodic signal content.

41. A product comprising:

a machine readable medium; and machine readable instructions embodied on the machine readable medium that:

delay an input signal comprising a fundamental frequency by multiple sample delays to obtain multiple differently delayed input signals;

apply a partitioned adaptive filter comprising multiple individual adaptive filters to the multiple delayed input signals;

generate a filtered output with the partitioned adaptive filter, the filtered output approximately delayed by an integer multiple of the fundamental frequency; and reinforce the input signal with the output estimate.

42. The product of claim 41, where the machine readable instructions further:

generate an error signal for each of the multiple individual adaptive filters; and adapt each of the individual adaptive filters based on the error signal for that individual adaptive filter.

43. The product of claim 42, where the delay instructions comprise:

D sample delay instructions, where D is selected to implement a maximum adaptation pitch for the multiple adaptive filters.

44. The product of claim 43, where the delay instructions further comprise:

L sample delay instructions, where L is selected to implement a pitch tracking range for the multiple adaptive filters.

45. The product of claim 44, where the pitch tracking range includes a human voice pitch.

46. The product of claim 44, where the L sample delay instructions implement 'i' series connected sample delay blocks, each of equal length.

47. The product of claim 44, where the L sample delay instructions implement 'i' series connected sample delay blocks, where at least two of the sample delay blocks have different lengths.

48. The product of claim 41, where the machine readable instructions further:

bias the estimated fundamental frequency output by a gain parameter.

49. The product of claim 48, where the gain parameter decreases with increasing signal-to-noise ratio.

50. The product of claim 48, where the gain parameter increases with decreasing signal-to-noise ratio.

51. The product of claim 41, where each of the multiple individual adaptive filters has a filter length of 1.

52. The product of claim 41, where the reinforce instructions comprise instructions that add the filtered output to the input signal to generate an enhanced signal output with reinforced periodic signal content.

* * * * *

UNITED STATES PATENT AND TRADEMARK OFFICE

CERTIFICATE OF CORRECTION

PATENT NO. : 7,610,196 B2
APPLICATION NO. : 11/102251
DATED : October 27, 2009
INVENTOR(S) : Nongpiur et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1099 days.

Signed and Sealed this

Twelfth Day of October, 2010

David J. Kappos

David J. Kappos
*Director of the United States Patent and Trademark Office*